US006159079A

United States Patent [19]

Zuniga et al.

[11] Patent Number: 6,159,079

[45] Date of Patent: Dec. 12, 2000

[54] CARRIER HEAD FOR CHEMICAL MECHANICAL POLISHING A SUBSTRATE

[75] Inventors: Steven Zuniga, Soquel; Hung Chen, San Jose; Manoocher Birang, Los Gatos, all of Calif.

[73] Assignee: Applied Materials, Inc., Santa Clara, Calif.

[21] Appl. No.: 09/149,806

[22] Filed: Sep. 8, 1998

[51] Int. Cl.[7] ..... B24B 1/00

[52] U.S. Cl. ..... 451/41; 451/285; 451/286; 451/282; 451/288; 451/289; 451/388; 451/398

[58] Field of Search ..... 451/285–289, 451/388, 390, 460, 398

[56] References Cited

U.S. PATENT DOCUMENTS

| | | | |
|---|---|---|---|
| 4,669,915 | 6/1987 | Shatto, Jr. . | |
| 4,918,869 | 4/1990 | Kitta . | |
| 5,193,316 | 3/1993 | Olmstead . | |
| 5,205,082 | 4/1993 | Shendon et al. . | |
| 5,423,716 | 6/1995 | Strasbaugh . | |
| 5,449,316 | 9/1995 | Strasbaugh | 451/289 |
| 5,584,751 | 12/1996 | Kobayashi et al. . | |
| 5,624,299 | 4/1997 | Shendon | 451/28 |
| 5,643,053 | 7/1997 | Shendon . | |
| 5,643,061 | 7/1997 | Jackson et al. . | |
| 5,759,918 | 6/1998 | Hoshizaki et al. . | |
| 5,803,799 | 9/1998 | Volodarsky et al. . | |
| 5,851,140 | 12/1998 | Barns et al. | 451/398 |
| 5,879,220 | 3/1999 | Hasegawa et al. . | |
| 5,916,015 | 6/1999 | Natalicio | 451/288 |
| 5,941,758 | 8/1999 | Mack | 451/41 |
| 5,957,751 | 9/1999 | Govzman et al. . | |
| 5,964,653 | 10/1999 | Perlov et al. . | |
| 5,993,302 | 11/1999 | Chen et al. | 451/398 |
| 6,083,089 | 7/2000 | Breivogel et al. | 451/287 |

FOREIGN PATENT DOCUMENTS

| | | |
|---|---|---|
| 0841 123 A1 | 5/1998 | European Pat. Off. . |
| 3313707 A1 | 10/1984 | Germany . |
| 2243263 | 9/1990 | Japan . |
| WO 99/07516 | 2/1999 | WIPO . |
| WO 99/33613 | 7/1999 | WIPO . |

*Primary Examiner*—Derris H. Banks
*Assistant Examiner*—George Nguyen
*Attorney, Agent, or Firm*—Fish & Richardson

[57] ABSTRACT

A carrier head for a chemical mechanical polishing apparatus includes a flexible membrane with a lip portion to engage a substrate to form a seal for improved vacuum-chucking.

26 Claims, 4 Drawing Sheets

CARRIER HEAD FOR CHEMICAL MECHANICAL POLISHING A SUBSTRATE

BACKGROUND

The present invention relates generally to chemical mechanical polishing of substrates, and more particularly to a carrier head for chemical mechanical polishing a substrate.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CAP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

One problem encountered in CMP is that a central portion of the substrate is often underpcolished. This problem, which may be termed the "center slow effect", may occur even if pressure is uniformly applied to the backside of the substrate.

Another problem is the difficulty in removing the substrate from the polishing pad surface once polishing has been completed. As mentioned, a layer of slurry is supplied to the surface of the polishing pad. When the substrate is placed in contact with the polishing pad, the surface tension of the slurry generates an adhesive force which binds the substrate to the polishing pad. The adhesive force may make it difficult to remove the substrate from the pad.

Typically, the substrate is vacuum-chucked to the underside of the carrier head, and the carrier head is used to remove the substrate from the polishing pad. When the carrier head is retracted from the polishing pad, the substrate is lifted off the pad. However, if the surface tension holding the substrate on the polishing pad is greater than the vacuum-chucking force holding the substrate on the carrier head, then the substrate will remain on the polishing pad when the carrier head retracts. This may cause the substrate to fracture or chip. In addition, failure to remove the substrate can cause a machine fault requiring manual intervention. This requires shutting down the polishing apparatus, decreasing throughput. To achieve reliable operation from the polishing apparatus, the substrate removal process should be essentially flawless.

Several techniques have been employed to reduce the surface tension between the substrate to the polishing pad. Once such technique is to slide the substrate horizontally off the polishing pad to break the surface tension before vertically retracting the carrier head. This technique may, however, scratch or otherwise damage the substrate as it may detach from the carrier head as it slides off the edge of the polishing pad. The mechanical configuration of the CMP apparatus may also prohibit use of this technique.

Another technique is to treat the surface of the polishing pad to reduce the surface tension. However, this technique is not always successful, and such treatment of the pad surface may adversely affect the finish and flatness of the substrate and reduce the polishing rate.

Another technique is to apply a downward pressure to the edge of the substrate to create a seal that prevents ambient atmosphere from interfering with the vacuum-chucking process. However, this technique may require complex pneumatic controls for the carrier head. In addition, the structure of the carrier head may prevent the application of pressure to the edge of the substrate.

SUMMARY

In one aspect, the invention is directed to a carrier head for chemical mechanical polishing of a substrate. The carrier head has a base and a flexible membrane extending beneath the base to define a pressurizable chamber. A lower surface of the flexible membrane provides a mounting surface for applying a load to a substrate. The flexible membrane includes an inner portion and a lip portion surrounding the inner portion, the lip portion positioned and arranged such that, when a substrate is positioned against the mounting surface and the chamber is evacuated to pull the inner portion of the flexible membrane away from the substrate, the lip portion will be pulled against the substrate to form a seal therebetween.

Implementations of the invention may include one or more of the following. The flexible membrane may include a juncture formed between the lip portion and the inner portion. The juncture may be twice as thick as the inner portion. The inner portion may be about 29 and 33 mils thick and the juncture may be about 60 and 66 mils thick. The lip portion may be thicker adjacent the juncture than at an outer rim portion thereof, and may taper from a thickness about equal to the thickness of the juncture to a thickness about equal to the thickness of the inner portion. An edge portion of the flexible membrane may connect the inner portion and lip portion to the base. At least part of the edge portion might fold over the lip portion, or the edge portion might not extend over the lip portion. The lip portion may contact a perimeter portion of the substrate. A retaining ring may surround the mounting surface to maintain the substrate beneath the carrier head. The flexible membrane may be connected to a support structure, and the support structure may be movably connected to the base. An edge portion of the flexible membrane may extend between an outer surface of the support structure and an inner surface of a retaining ring. An edge portion of the flexible membrane may extend around an outer surface of the support structure and across a portion of a top surface of the support structure. The support structure may include a support plate and a clamp, and the flexible membrane may be clamped between the support plate and the clamp. A projection may extend downwardly from a lower surface of the support structure. The projection may be formed integrally with the support structure, or it may comprise a layer of compressible material disposed on the lower surface of the support structure. The lip portion may project downwardly from the flexible membrane to extend past the projection from the support structure.

In another aspect, the invention is directed to a method of chemical mechanical polishing. A substrate is positioned on a mounting surface of a carrier head that includes a base and a flexible membrane extending beneath the base to define a pressurizable chamber, a lower surface of the flexible membrane providing the mounting surface. The chamber is pressurized to urge the substrate into contact with a moving polishing surface, and the chamber is evacuated to pull an inner portion of the flexible membrane away from the substrate and pull a lip portion of the membrane against the substrate to form a seal therebetween.

Implementation of the invention may include pressurizing the chamber to force the inner portion of the flexible membrane outwardly and urge the lip portion of the flexible membrane away from the substrate to break the seal.

Advantages of the invention may include the following. The substrate can be reliably removed from the polishing pad. Underpolishing of the center of the substrate is reduced, and the resulting flatness of the substrate is improved.

Other advantages and features of the invention will be apparent from the following description, including the drawings and claims.

BRIEF DESCRIPTION OF THE DRAWINGS

Like reference numbers are designated in the various drawings to indicate like elements. A primed reference number indicates that an element has a modified function, operation or structure.

Detailed Description

Figure 1:
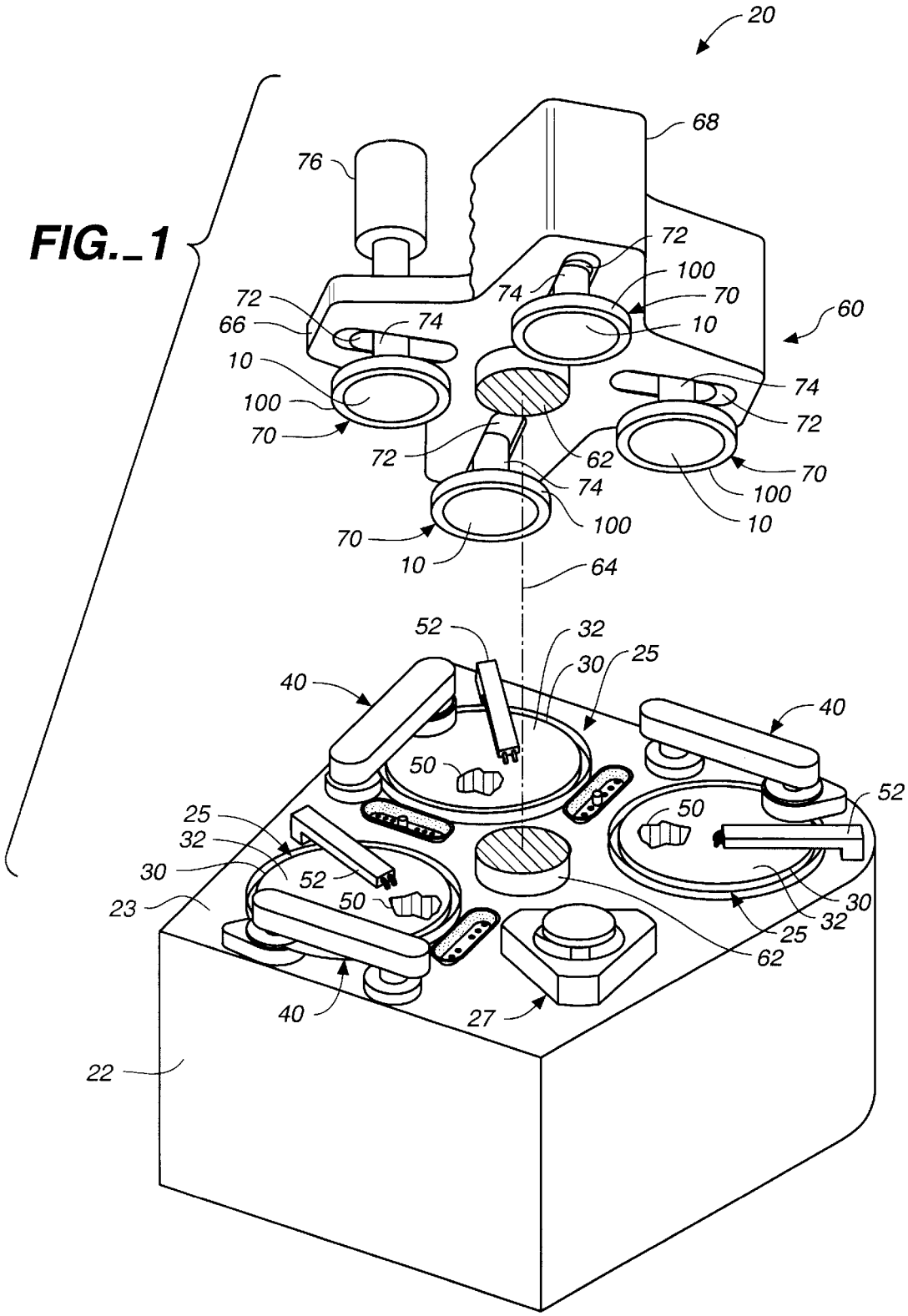
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a lower machine base 22 with a table top 23 mounted thereon and a removable upper outer cover (not shown). Table top 23 supports a series of polishing stations 25, and a transfer station 27 for loading and unloading the substrates. The transfer station may form a generally square arrangement with the three polishing stations.

Each polishing station includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 may be connected to a platen drive motor (not shown) located inside machine base 22. For most polishing processes, the platen drive motor rotates platen 30 at thirty to two-hundred revolutions per minute, although lower or higher rotational speeds may be used. Each polishing station may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70 mounted on carousel support plate 66 at equal angular intervals about carousel axis 64. Three of the carrier head systems receive and hold substrates and polish them by pressing them against the polishing pads of the polishing stations. One of the carrier head systems receives a substrate from and delivers the substrate to transfer station 27. The carousel motor may orbit the carrier head systems, and the substrates attached thereto, about carousel axis 64 between the polishing stations and the transfer station.

Each carrier head system includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
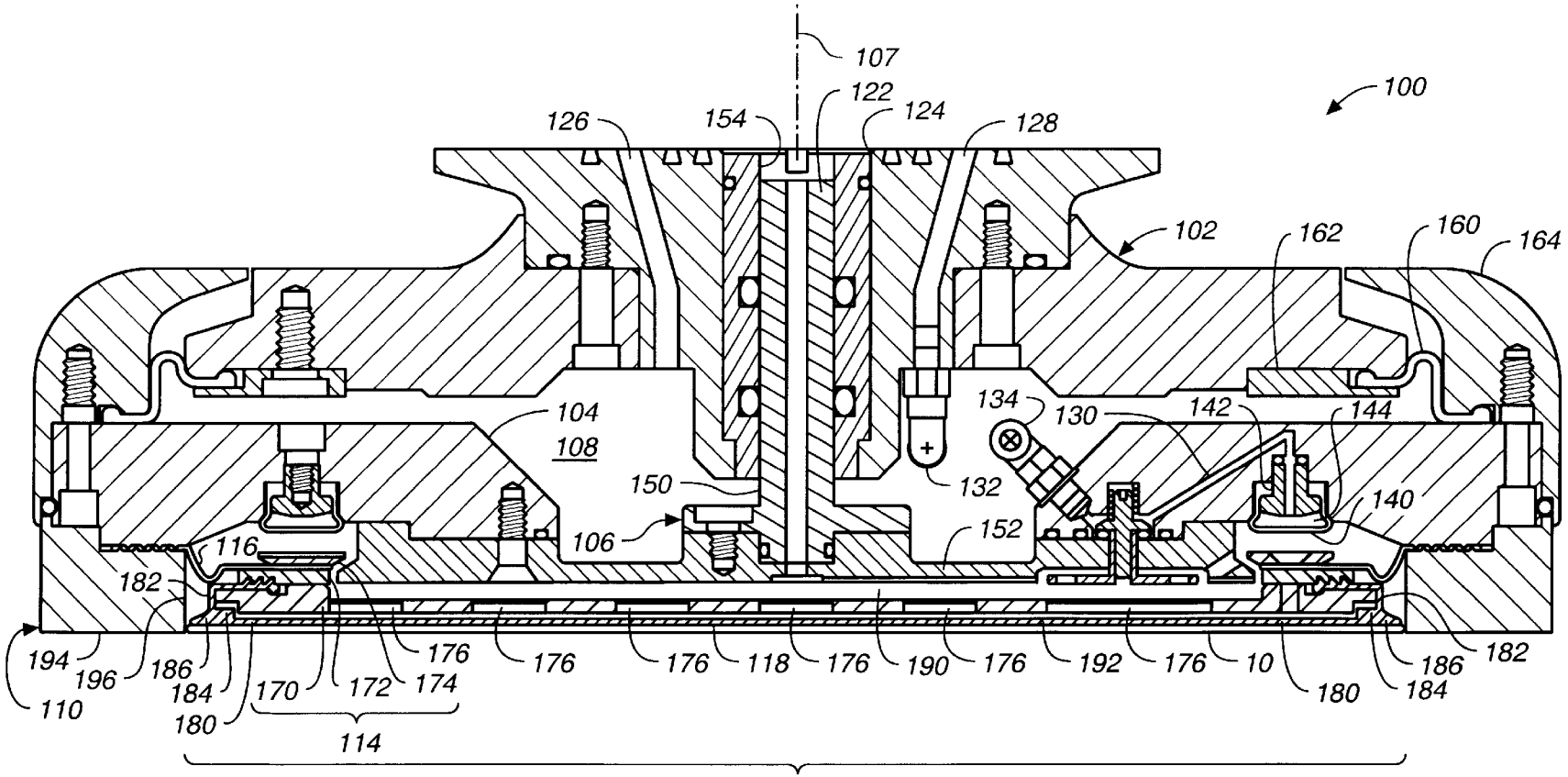
FIG. 2 is a schematic cross-sectional view of a carrier head according to the present invention.
Figure 3:
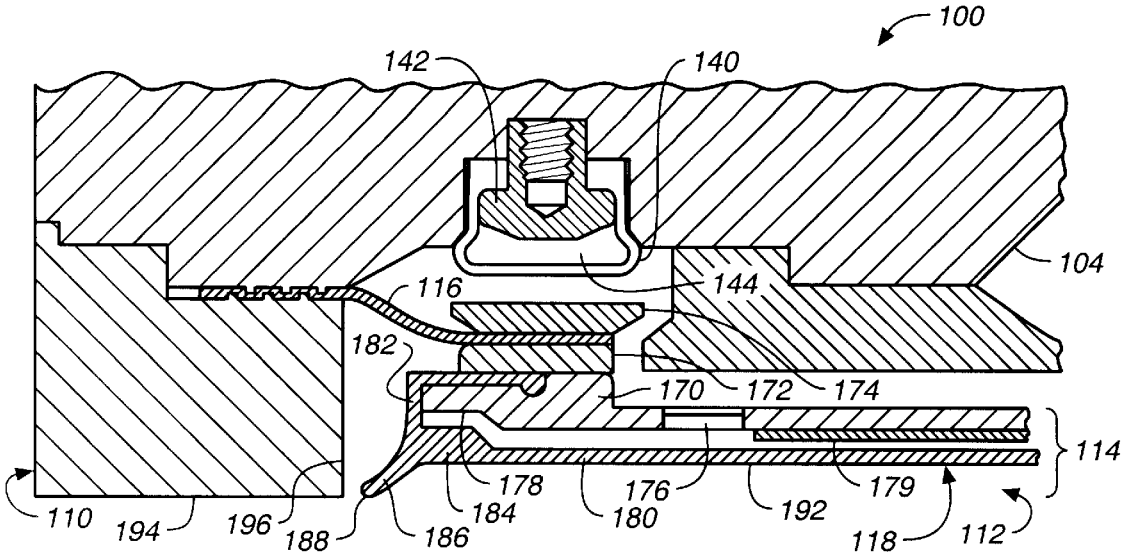
FIG. 3 is an enlarged view of the carrier head of FIG. 2 showing a flexible lip at the edge of a flexible membrane.

Referring to FIGS. 2 and 3, carrier head 100 includes a housing 102, a base 104, a gimbal mechanism 106, a loading chamber 108, a retaining ring 110, and a substrate backing assembly 112. A description of a similar carrier head may be found in U.S. application Ser. No. 08/745,670 by Zuniga, et al., filed Nov. 8, 1996, entitled A CARRIER HEAD WITH A FLEXIBLE MEMBRANE FOR A CHEMICAL MECHANICAL POLISHING SYSTEM, and assigned to the assignee of the present invention, the entire disclosure of which is incorporated herein by reference.

Housing 102 can be connected to drive shaft 74 to rotate therewith during polishing about an axis of rotation 107 which is substantially perpendicular to the surface of the polishing pad during polishing. Loading chamber 108 is located between housing 102 and base 104 to apply a load, i.e., a downward pressure, to base 104. The vertical position of base 104 relative to polishing pad 32 is also controlled by loading chamber 108.

Substrate backing assembly 112 includes a support structure 114, a flexure diaphragm 116 connecting support structure 114 to base 104, and a flexible member or membrane 118 connected to support structure 114. Flexible membrane 118 extends below support structure 114 to provide a mounting surface 192 for the substrate. The sealed volume between flexible membrane 118, support structure 114, flexure diaphragm 116, base 104, and gimbal mechanism 106 defines a pressurizable chamber 190. Pressurization of chamber 190 forces flexible membrane 118 downwardly to press the substrate against the polishing pad. A first pump (not shown) may be fluidly connected to chamber 190 to control the pressure in the chamber and thus the downward force of the flexible membrane on the substrate.

Housing 102 may be generally circular in shape to correspond to the circular configuration of the substrate to be polished. A cylindrical bushing 122 may fit into a vertical bore 124 through the housing, and two passages 126 and 128 may extend through the housing for pneumatic control of the carrier head.

Base 104 is a generally ring-shaped body formed of a rigid material and located beneath housing 102. A passage 130 may extend through the base, and two fixtures 132 and 134 may provide attachment points to connect a flexible tube between housing 102 and base 104 to fluidly couple passage 128 to passage 130.

An elastic and flexible membrane 140 may be attached to the lower surface of base 104 by a clamp ring 142 to define a bladder 144. Clamp ring 142 may be secured to base 104 by screws or bolts (not shown). A second (not shown) may be connected to bladder 144 to direct a fluid, e.g., a gas, such as air, into or out of the bladder and thereby control a downward pressure on support structure 114. Specifically, bladder 144 may be used to cause a projection 179 from a support plate 170 of support structure 114 to press a central area of flexible membrane 118 against substrate 10, thereby applying additional pressure to the central portion of the substrate.

Gimbal mechanism 106 permits base 104 to pivot with respect to housing 102 so that the base may remain substantially parallel with the surface of the polishing pad. Gimbal mechanism 106 includes a gimbal rod 150 which fits into a passage 154 through cylindrical bushing 122 and a flexure ring 152 which is secured to base 104. Gimbal rod 150 may slide vertically along passage 154 to provide vertical motion of base 104, but it prevents any lateral motion of base 104 with respect to housing 102.

An inner edge of a generally ring-shaped rolling diaphragm 160 may be clamped to housing 102 by an inner clamp ring 162. An outer clamp ring 164 may clamp an outer edge of rolling diaphragm 160 to base 104. Thus, rolling diaphragm 160 seals the space between housing 102 and base 104 to define loading chamber 108. A third pump (not shown) may be fluidly connected to loading chamber 108 to control the pressure in the loading chamber and the load applied to base 104.

Retaining ring 110 may be a generally annular ring secured at the outer edge of base 104, e.g., by bolts (not shown). When fluid is pumped into loading chamber 108 and base 104 is pushed downwardly, retaining ring 110 is also pushed downwardly to apply a load to polishing pad 32. A bottom surface 194 of retaining ring 110 may be substantially flat, or it may have a plurality of channels to facilitate transport of slurry from outside the retaining ring to the substrate. An inner surface 196 of retaining ring 110 engages the substrate to prevent it from escaping from beneath the carrier head.

Support structure 114 of substrate backing assembly 112 includes support plate 170, an annular lower clamp 172, and an annular upper clamp 174. Support plate 170 may be a generally disk-shaped rigid member having a plurality of apertures 176 formed therethrough. The outer surface of support plate 170 may be separated from inner surface 196 of retaining ring 110 by a gap having a width of about 3 mm. An annular recess 178 having a width W1 of about 2–4 mm, e.g., 3 mm, may be formed in the outer edge of support plate 170. In addition, projection 179 (see FIG. 3) may extend downwardly from a central region of the bottom surface of the support plate. The projection may be formed by attaching a carrier film to the bottom of the support plate, or it may be formed integrally with the support plate. Support plate 170 may not include apertures through the area above projection 179. Alternately, the apertures may extend through both the support plate and the projection.

Flexure diaphragm 116 of substrate backing assembly 112 is a generally planar annular ring. An inner edge of flexure diaphragm 116 is clamped between base 104 and retaining ring 110, and an outer edge of flexure diaphragm 116 is clamped between lower clamp 172 and upper clamp 174. Flexure diaphragm 116 is flexible and elastic, although it could be rigid in the radial and tangential directions. Flexure diaphragm 116 may formed of rubber, such as neoprene, an elastomeric-coated fabric, such as NYLON™ or NOMEX™, plastic, or a composite material, such as fiberglass.

Flexible membrane 118 is a generally circular sheet formed of a flexible and elastic material, such as chloroprene or ethylene propylene rubber. Flexible membrane 118 includes an inner portion 180, an annular edge portion 182 which extends around the edges of support plate 170 to be clamped between the support plate and lower clamp 172, and a flexible lip portion 186 which extends outwardly from a juncture 184 between inner portion 180 and edge portion 182 to contact a perimeter portion of a substrate loaded in the carrier head. The juncture 184 is located generally beneath recess 178 in support plate 170, and is thicker, e.g., about twice as thick, than inner portion 180 or edge portion 182.

The lip portion 186 may be wedge-shaped and taper from a thickness about equal to that of the juncture to a thickness at its outer rim 188 about equal to that of inner portion 180 of flexible membrane 118. Outer rim 188 of lip portion 186 may be angled toward the substrate. Specifically, the lip portion should extend sufficiently downwardly so that, if chamber 190 is evacuated and flexible membrane 118 is pulled upwardly, rim 188 of lip portion 180 still extends below projection 179 on support plate 170. This ensures that a seal can be formed between the substrate and flexible membrane even if projection 179 prevents the application of pressure to the edge of the substrate. As discussed in greater detail below, lip portion 186 assists in the removal of the substrate from the polishing pad.

In one implementation, the inner and edge portions of flexible membrane 118 may be about 29–33 mils thick, whereas the juncture section may be about 60–66 mils thick and may extend inwardly from the edge portion about 1–5 mm, e.g., 3.5 mm. The lip portion may extend downwardly at an angle of about 0–30°, e.g., 15°, from inner portion 180, and may extend about 1–5 mm, e.g., 3.5 mm, beyond edge portion 182.

As previously discussed, one reoccurring problem in CMP is underpolishing of the substrate center. Carrier head 100 may be used to reduce or minimize the center slow effect. Specifically, by providing support plate 170 with a projection 179 which contacts the upper surface of the flexible membrane in a generally circular contact area near the center of the substrate-receiving surface, additional pressure may be applied by bladder 144 to the potentially underpolished region at the center of the substrate. This additional pressure increases the polishing rate at the center of the substrate, improving polishing uniformity and reducing the center slow effect.

When polishing is completed, fluid is pumped out of chamber 190 to vacuum chuck the substrate to flexible membrane 118. Then loading chamber 108 is evacuated to lift base 104 and backing structure 112 off the polishing pad.

Figure 4A:
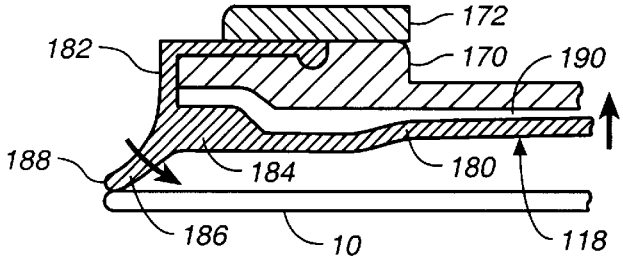
FIG. 4A is a view of the carrier head of FIG. 2 illustrating a method of removing the substrate from the polishing pad.
Figure 4B:
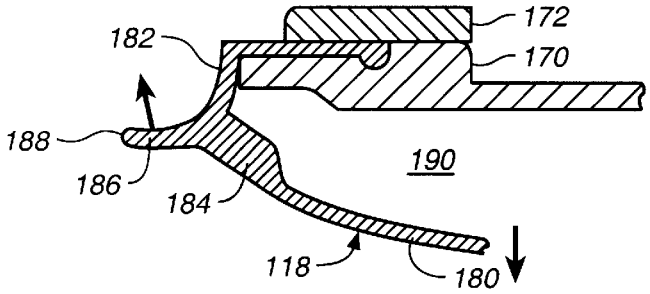
FIG. 4B is a view of the carrier head of FIG. 2 illustrating a method of removing the substrate from the carrier head.

As mentioned above, another reoccurring problem in CMP is the difficulty in removing the substrate from the polishing pad. However, carrier head 100 substantially eliminates this problem. Referring to FIG. 4A (for simplicity, only the elements involved in chucking and dechucking the substrate are illustrated in FIGS. 4A and 4B), when chamber 190 is evacuated, inner portion 180 of flexible membrane 118 is pulled inwardly. This causes a decrease in pressure in the volume between the backside of the substrate and the mounting surface of the flexible membrane. The decrease in pressure causes lip portion 186 to be drawn against a perimeter portion of the substrate to form a seal therebetween. This provides an effective vacuum-chuck of the substrate to the flexible membrane. Thus, when loading chamber 108 is evacuated, substrate 10 will be securely held to the carrier head. In addition, the seal is sufficiently fluid-tight that it may not be necessary to apply an additional downward force to the portion of the flexible membrane over the perimeter of the substrate to form the seal. Consequently, the seal may be implemented without requiring additional pneumatic controls in the carrier head.

Referring to FIG. 4B, to remove the substrate from the carrier head, fluid is pumped into chamber 190. This causes inner portion 180 to bulge outwardly, causing juncture 184 to pivot downwardly. Consequently, lip portion 186 pivots upwardly so that it lifts away from the substrate. This breaks the seal between the flexible membrane and substrate, and the downward pressure from the inner portion of the flexible membrane dechucks the substrate from the carrier head. The thickness of juncture 184 should be selected to provide sufficient rigidity to ensure that the lip portion pivots upwardly when the inner portion of flexible membrane 118 is urged downwardly.

Figure 5:
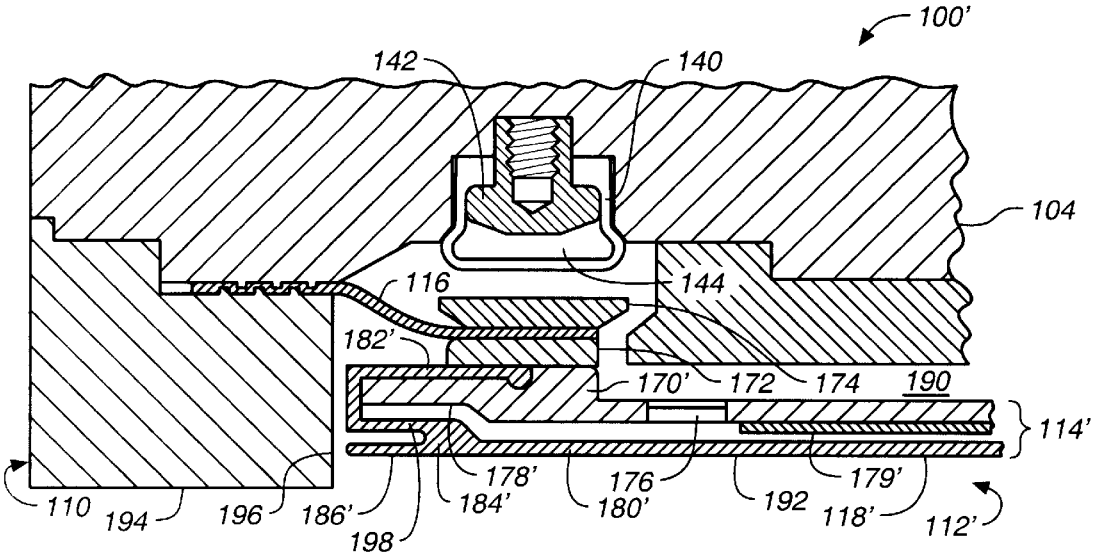
FIG. 5 is a cross-sectional view of a carrier head in which the edge portion of the flexible membrane extends over the lip portion.

Referring to FIG. 5, a carrier head 100' may include a flexible membrane 118' that folds over lip portion 186'. An advantage of this implementation is that the gap between the outer cylindrical surface of support plate 170' and the inner surface of retaining ring 110 is smaller. The edge portion 182' of flexible membrane 118' includes a folded portion 198 which extends over lip portion 186' to connect to juncture 184'. The folded portion 198 may fit into recess 178' in support plate 170'. Support plate 170' may also include a projection 179' that is formed integrally with the support plate.

The present invention has been described in terms of a number of embodiments. The invention, however, is not limited to the embodiments depicted and described. Rather, the scope of the invention is defined by the appended claims.

What is claimed is:

1. A carrier head for chemical mechanical polishing of a substrate, comprising:

a base; and a flexible membrane extending beneath the base to define a pressurizable chamber, a lower surface of the flexible membrane providing a mounting surface for applying a load to a substrate, the flexible membrane including an inner portion and a lip portion surrounding the inner portion, the lip portion positioned and arranged such that, when a substrate is positioned against the mounting surface and the chamber is evacuated to pull the inner portion of the flexible membrane away from the substrate, the lip portion will be drawn against the substrate to form a seal therebetween.

2. The carrier head of claim 1, wherein the flexible membrane includes a juncture formed between the lip portion and the inner portion, the juncture being thicker than the inner portion.

3. The carrier head of claim 2, wherein the juncture is about twice as thick as the inner portion.

4. The carrier head of claim 2, wherein the inner portion is between about 29 and 33 mils thick.

5. The carrier head of claim 2, wherein the juncture is between about 60 and 66 mils thick.

6. The carrier head of claim 2, wherein the lip portion is thicker adjacent the juncture than at an outer rim portion thereof.

7. The carrier head of claim 6, wherein the lip portion tapers from a thickness about equal to the thickness of the juncture to a thickness about equal to the thickness of the inner portion.

8. The carrier head of claim 1, wherein the flexible membrane further includes an edge portion connecting the inner portion and lip portion to the base.

9. The carrier head of claim 8, wherein at least part of the edge portion folds over the lip portion.

10. The carrier head of claim 8, wherein the edge portion does not extend over the lip portion.

11. The carrier head of claim 1, wherein the lip portion extends from a juncture between the inner portion and the edge portion.

12. The carrier head of claim 11, wherein the juncture is thicker than the inner portion.

13. The carrier head of claim 1, wherein the lip portion contacts a perimeter portion of the substrate.

14. The carrier head of claim 1, further comprising a retaining ring surrounding the mounting surface to maintain the substrate beneath the carrier head.

15. The carrier head of claim 1, wherein the flexible membrane is connected to a support structure, and the support structure is movably connected to the base.

16. The carrier head of claim 15, wherein an edge portion of the flexible membrane extends between an outer surface of the support structure and an inner surface of a retaining ring.

17. The carrier head of claim 15, wherein an edge portion of the flexible membrane extends around an outer surface of the support structure and across a portion of a top surface of the support structure.

18. The carrier head of claim 15, wherein the support structure includes a support plate and a clamp, and the flexible membrane is clamped between the support plate and the clamp.

19. The carrier head of claim 15, wherein a projection extends downwardly from a lower surface of the support structure.

20. The carrier head of claim 19, wherein the projection is formed integrally with the support structure.

21. The carrier head of claim 19, wherein the projection comprises a layer of compressible material disposed on the lower surface of the support structure.

22. The carrier head of claim 19, wherein the lip portion projects downwardly from the flexible membrane to extend past the projection from the support structure.

23. A carrier head for chemical mechanical polishing of a substrate, comprising:

a base;

a support structure movably connected to the base; and a flexible membrane extending beneath the base to define a pressurizable chamber, a lower surface of the flexible membrane providing a mounting surface for applying a load to a substrate, the flexible membrane including an inner portion and a lip portion surrounding the inner portion, the lip portion positioned and arranged such that, when a substrate is positioned against the mounting surface and the chamber is evacuated to pull the inner portion of the flexible membrane away from the substrate, the lip portion will be drawn against the substrate to form a seal therebetween;

wherein a projection extends downwardly from a lower surface of the support structure to contact a top surface of the flexible membrane.

24. A chemical mechanical polishing apparatus, comprising:

a rotatable polishing pad;

a slurry supply to provide slurry to the polishing pad; and a carrier head including a base and a flexible membrane extending beneath the base to define a pressurizable chamber, a lower surface of the flexible membrane providing a mounting surface for applying a load to a substrate, the flexible membrane including an inner portion and a lip portion surrounding the inner portion, the lip portion positioned and arranged such that, when a substrate is positioned against the mounting surface and the (chamber is evacuated to pull the inner portion of the flexible membrane away from the substrate, the lip portion will be drawn against the substrate to form a seal therebetween.

25. A method of chemical mechanical polishing, comprising:

positioning a substrate on a mounting surface of a carrier head that includes a base and a flexible membrane extending beneath the base to define a pressurizable chamber, a lower surface of the flexible membrane providing the mounting surface the flexible membrane including a lip portion;

pressurizing the chamber to urge the substrate into contact with a polishing surface;

creating relative motion between the substrate and the polishing surface; and evacuating the chamber to pull an inner portion of the flexible membrane away from the substrate and draw the lip portion of the membrane against the substrate to form a seal therebetween.

26. The method of claim 25, further comprising pressurizing the chamber to force the inner portion of the flexible membrane outwardly and urge the lip portion of the flexible membrane away from the substrate to break the seal.

* * * * *